US010080439B2

(12) United States Patent
Kjellman

(10) Patent No.: US 10,080,439 B2
(45) Date of Patent: Sep. 25, 2018

(54) HUB CONSTRUCTION FOR A ROTATABLE CHAIR

(71) Applicant: AF Solutions Ab Oy, Jakobstad (FI)

(72) Inventor: Fredrik Kjellman, Jakobstad (FI)

(73) Assignee: AF Solutions Ab Oy, Jakobstad (FI)

( * ) Notice: Subject to any disclaimer, the term of this patent is extended or adjusted under 35 U.S.C. 154(b) by 17 days.

(21) Appl. No.: 15/585,240

(22) Filed: May 3, 2017

(65) Prior Publication Data

US 2017/0318967 A1 Nov. 9, 2017

(30) Foreign Application Priority Data

May 4, 2016 (FI) ..... 20165386

(51) Int. Cl.
*A47C 7/00* (2006.01)
*A47C 3/18* (2006.01)

(52) U.S. Cl.
CPC ..... *A47C 3/185* (2013.01)

(58) Field of Classification Search
CPC ..... A47C 3/18
USPC ..... 248/415, 417, 418; 297/344.21, 344.22
See application file for complete search history.

(56) References Cited

U.S. PATENT DOCUMENTS

| | | | | | |
|---|---|---|---|---|---|
| 1,532,354 | A * | 4/1925 | Walton | A47C 3/18 | 248/417 |
| 2,755,842 | A | 7/1956 | Caramelli | | |
| 3,223,376 | A * | 12/1965 | Ciuffini | A47C 3/18 | 248/417 |
| 3,837,611 | A * | 9/1974 | Rhoades | A47C 3/18 | 248/417 |
| 5,265,838 | A * | 11/1993 | Kjellman | A47C 3/18 | 248/289.31 |
| 2015/0034790 | A1* | 2/2015 | Tsuboi | A47C 3/185 | 248/404 |

FOREIGN PATENT DOCUMENTS

| | | | |
|---|---|---|---|
| FI | 892250 | A | 11/1990 |
| JP | H07222637 | A | 8/1995 |
| KR | 20100106833 | A | 10/2010 |
| WO | WO9013242 | A1 | 11/1990 |
| WO | WO2011114286 | A1 | 9/2011 |

* cited by examiner

*Primary Examiner* — Steven M Marsh
(74) *Attorney, Agent, or Firm* — Seppo Laine Oy

(57) ABSTRACT

The invention relates to a hub construction for a rotatable chair, which automatically returns to the initial position when the chair is relieved. In a prior art hub the return force was counteracted mainly by the friction in the hub bearing, which, regardless thereof that the hub was loaded, was not always sufficient for the hub to maintain its rotational position, for example, when the sitting person lifted his feet off the floor. For obtaining higher friction when the hub is loaded, it has been provided with a brake. The brake can preferably be a pair of spring discs which are compressed when the hub is loaded, whereby the brake disc makes contact with the brake surface.

5 Claims, 3 Drawing Sheets

HUB CONSTRUCTION FOR A ROTATABLE CHAIR

The present invention relates to a hub construction for a rotatable chair, which automatically returns to the initial position when the chair is relieved, comprising a vertical shaft fastened to the lower side of the seat of the chair and a hub on the leg portion of the chair, to which hub the lower portion of the shaft is rotatably fastened, whereby the return movement is achieved by means of a cam surface acting in the axial direction on the end of a spring loaded sleeve enclosing the shaft, which cam surface is arranged to cooperate with a radially directed guide pin. For obtaining higher friction when the hub is loaded, it has been provided with a brake.

In patent JP H07222637 A, there is disclosed a hub construction for a rotatable chair, which automatically returns to the initial position, when the chair is relieved.

In patent KR 20100106833 A there is disclosed a rotatable chair.

In the Finnish patent 83590 there is disclosed a hub construction, characterized in that the guide pin is fastened to the lower portion of the shaft and that the spring loaded sleeve is rotationally rigidly mounted on the hub. Due to this construction the return force is barely noticeable when sitting on the chair. However, the chair may have a tendency to return to the initial position also when there is a load on the hub, especially when the sitting person lifts his feet off the floor.

The object of the present invention is to eliminate also this drawback. According to the invention the hub construction comprises a spring device, which is compressed when the hub is axially loaded, i.e. vertically, whereby a brake disc causes higher friction. The spring device is preferably a disc spring, in particular a pair of disc springs.

Figure 1:
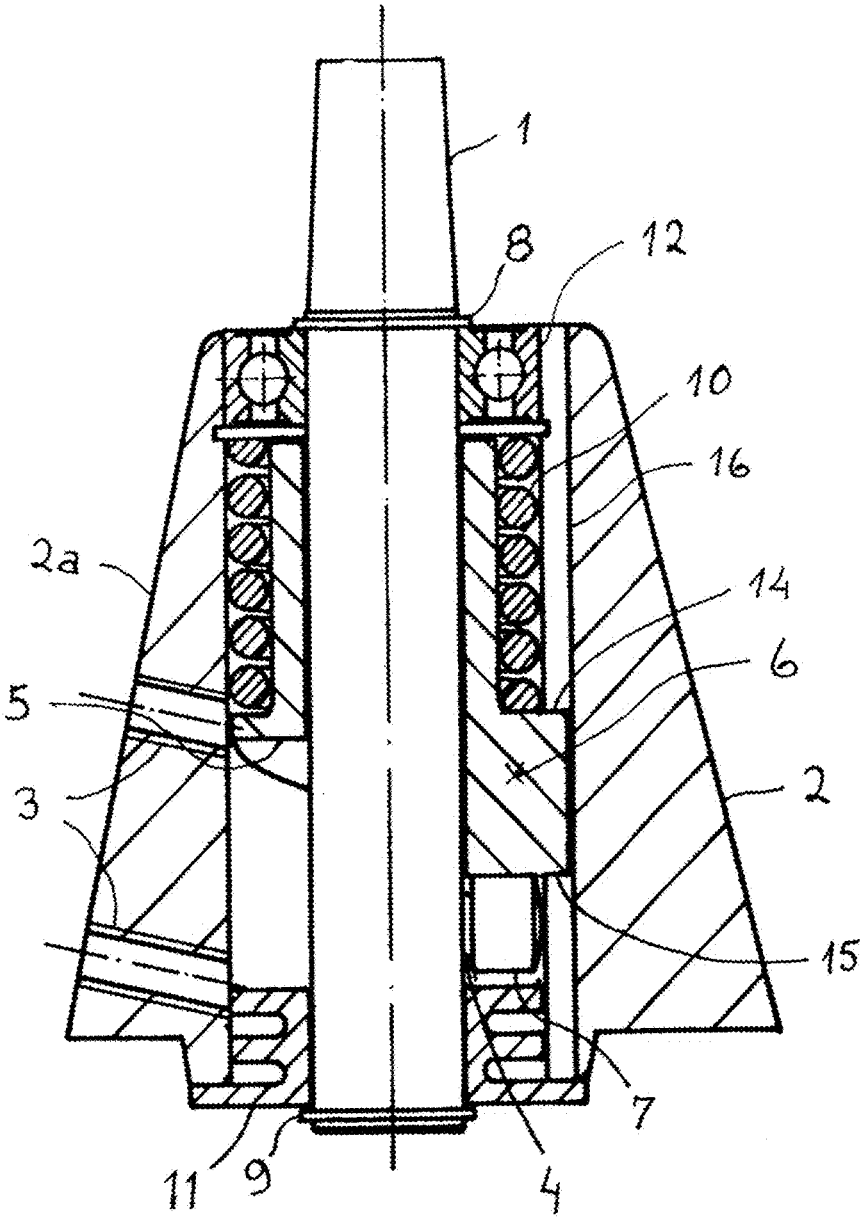
Figure 2:
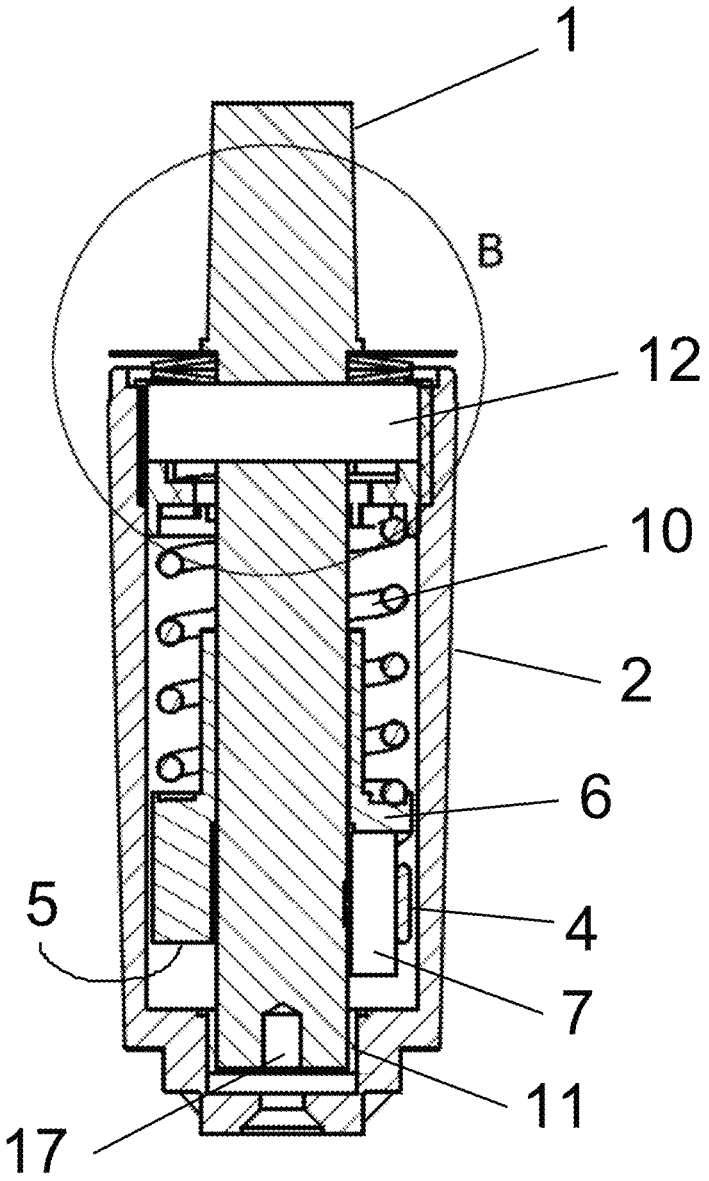
Figure 3:
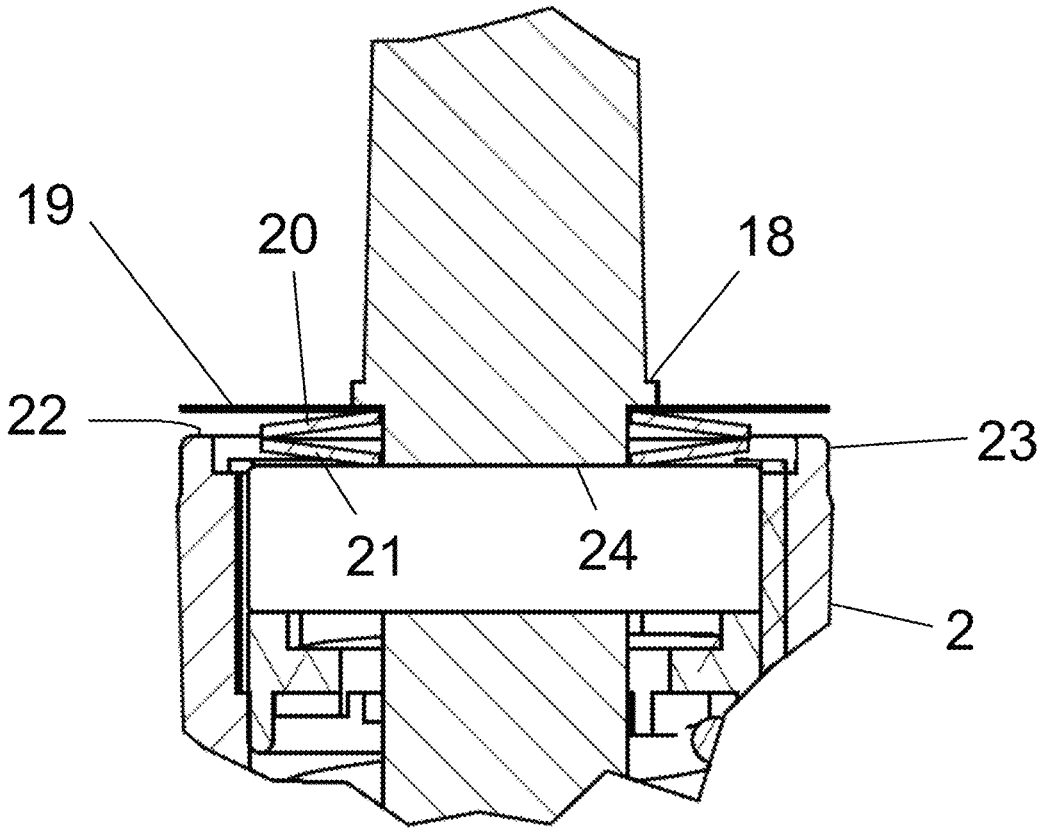

The invention is described in further detail in the following with reference to the accompanying drawing, in which FIG. 1 shows an embodiment of a hub construction according to FI 83590 seen in a side view, FIG. 2 shows an example of a hub construction according to the invention, and FIG. 3 shows a detail of the construction according to the invention as indicated by B in FIG. 2.

A prior art hub construction according to FIG. 1 comprises a vertical shaft 1, which is stationary fastened to the underside of a seat of a rotatable chair, and a hub 2 on the leg portion of the chair, to which hub 2 the lower portion of the shaft 1 is rotatably fastened. In this embodiment the hub 2 has externally the form of a truncated pyramid, whereby each side 2*a* is provided with threaded fastening holes 3 for the legs of the chair.

The vertical shaft 1 has in its lower portion a radially projecting guide pin 4, which is arranged to act against a cam surface 5 acting in the axial direction and located on the end of an axially movable sleeve 6 spring-loaded in the direction against the cam surface 5, which sleeve encloses the shaft 1. When the chair is unoccupied, the sleeve 6 is pushed by the spring force against the guide pin 4 on the axially stationary shaft 1, whereby the cam surface 5 via the guide pin 4 forces the shaft 1 to turn until the guide pin 4 sets against the stable rest point of the cam surface 5, at which rest point the height of the sleeve 6 is at its lowest. When the leg portion of the chair is adjusted in such a way that the seat of the chair in this rest position points to the desired direction, it is ensured that the chair, independently of the direction it is momentarily turned when being relieved, automatically returns to its initial set position in an elegant and secure manner. When the seat of the chair is turned from its initial position in either direction, the shaft 1 turns, whereby the guide pin 4 advancing along the cam surface 5 presses the sleeve 6 against the spring force, which then increases and is able to return the seat to its initial position as soon as the chair is relieved. Since the return movement is achieved by means of the guide pin 4 and the cam surface 5 on the spring-loaded sleeve 6, the seat of the chair and thereby the shaft 1 can be turned without limitation by an arbitrary number of revolutions in either direction, after which it can return, when relieved, to its initial position by the shortest route, which results in a return movement of maximum 180°.

A roller 7 is preferably mounted around the guide pin 4 for ensuring that the friction between the cam surface 5 and the guide pin 4 is as low as possible.

A displacement of the shaft 1 axially in the hub 2 is prevented by means of an upper 8 and a lower 9 locking washer. The shaft is mounted in the hub by means of a plain bearing 11 in the lower portion and a ball bearing 12 in the upper portion.

According to the embodiment in FIG. 1, the spring-loaded sleeve 6 has a constant inner diameter mainly corresponding to the diameter of the shaft 1 along its whole length and an outer diameter, which nearest to the cam surface 5 mainly corresponds to the inner diameter of the hub 2 and via a radial extension 14 decreases to a smaller diameter mainly corresponding to the inner diameter of the pressure spring 10, whereby the pressure spring is arranged to enclose the narrower portion of the sleeve 6, the radial extension 14 serving as a contact surface. In this case, the shaft 1 primarily serves as a guide for the sleeve 6, and a robust construction is achieved.

For ensuring that the sleeve 6 does not turn around its shaft, it is preferably provided with at least a radially projecting key 15, which is arranged to be seated in an axial groove 16 on the inner peripheral surface of the hub 2.

The cam surface 5 is preferably formed as a radially directed end surface continually ascending along two curves of 180° in opposite directions from the lowest initial point.

FIG. 2 shows a hub construction according to the invention. Contrary to the hub in FIG. 1, this construction is intended for being fitted into a separate chair base and does thus not have the form nor the fastening holes as the construction in FIG. 1, but has straight sides. However, this is of no significance in regard to the features characteristic for the invention. The numbered components in FIG. 2 correspond, where applicable, to the ones shown in FIG. 1.

FIG. 3 shows the upper part of the hub construction in FIG. 2, as indicated by B, in greater detail.

In this construction the shaft 1 is arranged in the hub 2 via the ball bearing 12 in such a way that the shaft is axially movable in the inner ring of the bearing. At the lower end of the shaft there is thus space for an axial movement. Here, the lower end of the shaft can have a central guide pin 17.

In the upper part of the shaft there is a collar 18, under which a brake disc 19 is arranged. Under the brake disc 19, there are two opposite disc spring washers 20, 21 mounted around the shaft 1 in such a way that the inner periphery of the lower washer lies against a supporting plane 24, which here consists of the inner ring of the bearing 12. When the shaft is loaded in the vertical direction, the disc spring washers are compressed and the brake disc makes contact with the surface 22 at the upper edge 23 on the hub. This causes, when the shaft is rotating, friction that counteracts the force that seeks to return the hub into the central position. In a hub according to the patent FI 83590 this force was counteracted mainly by the friction in the hub bearing, which, regardless thereof that the hub was loaded, was not always sufficient for the hub to maintain its rotational position, for example, when the sitting person lifted his feet off the floor.

In order to control the braking power, the surface of the brake disc 19 can be treated in order to provide higher or lower friction against the hub. The brake disc can, for example, be lightly blasted.

The brake disc 19 can be manufactured of same spring steel as the disc spring plates 20, 21. The distance between the brake disc 19 and the brake surface 22 on the hub can be less than 2 mm when the hub is unloaded.

Pursuant to the invention the spring device can also be located elsewhere than indicated in FIGS. 2 and 3, for example, under the lower end of the shaft 1. Thus, other solutions than a disc spring, such as a coil spring, are also possible.

The invention claimed is:

1. A hub construction for a rotatable chair, which automatically returns to its initial position when the chair is relieved, comprising a vertical shaft fastened to an underside of a seat of the chair, and a hub on a leg portion of the chair, to which hub a lower portion of the shaft is rotatably fastened, whereby return movement is achieved by means of a cam surface acting in an axial direction on an end of a spring loaded sleeve enclosing the shaft, which cam surface is arranged to cooperate with a radially directed guide pin, which is fastened to the lower portion of the shaft and the spring loaded sleeve is mounted rotationally rigidly on the hub, characterized in that the shaft is arranged movably in the axial direction in its bearings in the hub, and a spring device and a brake disc are arranged in the hub in such a way, that when the shaft is vertically loaded, the shaft is displaced in the axial direction, and the spring device is compressed such that the brake disc makes contact with a surface on the hub.

2. The hub construction according to claim 1, wherein the shaft is provided with a collar in its upper part and the spring is located between the collar and a supporting plane.

3. The hub construction according to claim 1, wherein the spring is located under the lower end of the shaft.

4. The hub construction according to claim 1, wherein the brake disc is blasted in order to obtain higher friction.

5. The hub construction according to claim 1, wherein the movability of the shaft in the axial direction is at maximum 2 mm.

* * * * *